US010934900B2

(12) United States Patent
Schlee

(10) Patent No.: US 10,934,900 B2
(45) Date of Patent: Mar. 2, 2021

(54) VALVE FOR AN INTERNAL COMBUSTION ENGINE

(71) Applicant: MAN Truck & Bus AG, Munich (DE)

(72) Inventor: Dimitri Schlee, Bamberg (DE)

(73) Assignee: MAN TRUCK & BUS AG, Munich (DE)

( * ) Notice: Subject to any disclaimer, the term of this patent is extended or adjusted under 35 U.S.C. 154(b) by 73 days.

(21) Appl. No.: 16/116,466

(22) Filed: Aug. 29, 2018

(65) Prior Publication Data

US 2019/0063271 A1 Feb. 28, 2019

(30) Foreign Application Priority Data

Aug. 30, 2017 (DE) ..... 10 2017 119 887.3

(51) Int. Cl.

| | |
|---|---|
| ***F01L 3/20*** | (2006.01) |
| ***F01L 3/08*** | (2006.01) |
| ***F01L 3/06*** | (2006.01) |
| *F01L 3/22* | (2006.01) |
| *F01L 7/08* | (2006.01) |
| *F01L 7/10* | (2006.01) |
| *F01L 3/04* | (2006.01) |
| *F01L 9/02* | (2006.01) |

(52) U.S. Cl.

CPC ..... *F01L 3/20* (2013.01); *F01L 3/06* (2013.01); *F01L 3/04* (2013.01); *F01L 3/08* (2013.01); *F01L 3/22* (2013.01); *F01L 7/08* (2013.01); *F01L 7/10* (2013.01); *F01L 9/02* (2013.01); *F01L 2820/01* (2013.01)

(58) Field of Classification Search

CPC ..... F01L 3/20; F01L 3/06; F01L 3/22

USPC ..... 123/188.3, 188.11, 188.8, 188.2, 190.9

See application file for complete search history.

(56) References Cited

U.S. PATENT DOCUMENTS 1,916,550 A * 7/1933 Zahodiakin ..... F01P 3/14 123/81 D
2,401,006 A * 5/1946 Longoria ..... B22D 19/00 219/85.15

(Continued)

FOREIGN PATENT DOCUMENTS

DE 102006061128 A1 6/2008
DE 102013216188 A1 3/2015

(Continued)

OTHER PUBLICATIONS

S Nadarajah, the effect of swirl on the annular flow past an axisymmetric poppet valve, Publication Date Jun. 1, 1998, King's College London Centre for Heat Transfer and Fluid Flow Measurement, Department of Mechanical Engineering, vol. 212 issue: 6. (Year: 1998).*

*Primary Examiner* — Syed O Hasan
(74) *Attorney, Agent, or Firm* — Weber Rosselli & Cannon LLP

(57) ABSTRACT

The present disclosure relates to a valve, preferably an exhaust gas or gas exchange valve, having a valve head which has a front face and a rear face, the front face of the valve head including an edge region and a bulge towards the outside which has a crest region. The valve, in order to reduce the mass of the bulge of the valve head, including a laterally outer part section of the edge region that is of flatter configuration in comparison with a laterally inner part section of the edge region, or the edge region includes at least one discontinuity in cross section.

19 Claims, 6 Drawing Sheets

(56) References Cited

U.S. PATENT DOCUMENTS

| | | | | | |
|---|---|---|---|---|---|
| 2,435,948 | A | * | 2/1948 | Wischhusen | F16K 27/00<br>29/888.452 |
| 3,154,061 | A | * | 10/1964 | Henry-Biabaud | F02B 23/00<br>123/661 |

FOREIGN PATENT DOCUMENTS

| | | | |
|---|---|---|---|
| DE | 102014013503 | A1 | 3/2016 |
| EP | 0369967 | A1 | 5/1990 |
| EP | 1193375 | A1 | 4/2002 |
| JP | 2008240535 | A | 10/2008 |
| WO | 2005085605 | A1 | 9/2005 |

* cited by examiner

Vaulted valve 1 in accordance with the prior art

Neutral axis 4 of the valve head 3 for the valve 1

Valve V in accordance with the prior art

Neutral axis F of the valve head of the valve V

VALVE FOR AN INTERNAL COMBUSTION ENGINE

BACKGROUND

The present disclosure relates to a valve, preferably an exhaust gas and/or gas exchange valve, for an internal combustion engine, expediently for a motor vehicle, in particular a commercial vehicle, for example a lorry or an omnibus. The valve can likewise serve for offroad, marine and/or stationary internal combustion engines.

Valves for internal combustion engines of motor vehicles having a valve stem and a valve head are known in a very wide variety of embodiments. For instance, valves with a flat front face and hollow valves having an outwardly bulged front face are known from the prior art. The bulged front face serves to provide space for cooling ducts/spaces or to increase the mechanical strength of the valve which is weakened by way of a cavity. By way of very clean exhaust gas which is achieved as a result of high ignition pressures and, in particular, as a result of engine-internal exhaust gas measures (for example, emissions standards, for example Euro 5 standard or higher), valve heads and valve seats are prone to pronounced, abrasive wear. A reason for this is the elastic deformation of the valve head and sliding of the valve head on the valve seat during the ignition pressure loads. It is a problem that, in comparison with dirty exhaust gas, very clean exhaust gas provides no or only very little lubricant (soot) for wear reduction between the valve and the valve seat. In order to reduce the wear between the valve and the valve seat, it is known from practice to use relatively expensive wear-resistant materials and/or valve seat angles which are small but unfavourable in flow terms (for example, less than 30°).

DE 10 2014 013 503 A1 has already disclosed a vaulted valve which, despite clean, in particular low-soot exhaust gas, does not slide or slides at least only slightly on the valve seat ring in the case of ignition pressure loading and exhibits low wear as a result, preferably without it being necessary for flow disadvantages to be accepted. A disadvantage of this, however, is the relatively great bulge of the valve head, which bulge firstly entails additional weight and secondly sits relatively deeply in the combustion chamber during operation. As a consequence, the vaulted valve which is disclosed in DE 10 2014 013 503 A1 normally has a heavier mass than standard valves, which results in an influence on the dynamics of the valve train. Moreover, the bulge usually protrudes further into the combustion chamber during operation than in the case of standard valves. As a consequence, large valve pockets are required on the piston, which increase the price of the system. Moreover, the valve protrusion influences the combustion. Specifically in the case of petrol engines, the ignition can be impaired by way of an unfavourable arrangement, since the turbulence kinetic energy (TKE) and charge movement are reduced.

SUMMARY

It is an object of the present disclosure to provide a valve for an internal combustion engine, which valve can be produced in a structurally simple and/or inexpensive manner, is relatively lightweight and/or the influence of which on the combustion of the internal combustion engine is reduced, in particular in comparison with the vaulted valve which is described in DE 10 2014 013 503 A1.

The present disclosure provides a valve, preferably an exhaust gas and/or gas exchange valve, for an internal combustion engine, preferably for a motor vehicle. The valve has, for example, a valve stem and a valve head. The valve head comprises a front face and a rear face. The front face expediently serves for load-side positioning, in particular on the combustion chamber side and/or the pressure chamber side, with the result that, during operation, it expediently faces the load side, in particular the pressure chamber side and/or combustion chamber side.

The front face of the valve head preferably has an expediently substantially centrally arranged bulge with a crest region. Furthermore, the front face expediently has an edge region which can extend, in particular, around the bulge and can be part of the bulge in sections, and can run in sections laterally next to and outside the bulge.

The valve is distinguished, in particular, by the fact that, preferably in order to reduce the mass of the bulge of the valve head, in particular to reduce the mass of the bulge base (expediently bulge bottom), a laterally outer part section of the edge region is of flatter configuration in comparison with a laterally inner part section of the edge region, and/or the edge region expediently comprises at least one discontinuity in cross section.

Moreover, a cross-sectional area of the bulge can expediently be reduced as a result, so that the interference area can preferably be reduced during operation.

In principle, the valve as disclosed herein can preferably be configured substantially in accordance with the vaulted valve which is described in DE 10 2014 013 503 A1. In the case of the vaulted valve which is described in DE 10 2014 013 503 A1, it is possible that, during operation, the edge region is not loaded or is at least not loaded substantially, for example by way of a pressure force and/or valve spring force.

The valve as disclosed herein is therefore configured in such a way that the mass which is not loaded or is loaded only insubstantially during operation in the edge region of the bulge, in particular the mass of the bulge base, which mass is not loaded or is loaded only insubstantially during operation, has been removed at least substantially.

Despite an identical minimum wall thickness of the valve head in comparison with the vaulted valve in accordance with DE 10 2014 013 503 A1, it can be made possible as a result, for example, that, during operation, the maximum stress of the valve head as disclosed herein and the maximum stress of the valve head in accordance with DE 10 2014 013 503 A1 are of substantially identical magnitude.

The at least one discontinuity may be at least one vertex (for example, at least one high point and/or low point), at least one inflection point and/or at least one reversal point.

In cross section, the at least one discontinuity may be arranged on the outside relative to a laterally inner end of the edge region and/or is arranged on the inside relative to a laterally outer end of the edge region.

The laterally inner end can adjoin, for example, the crest region, it being possible as an alternative or in addition for the laterally outer end to be the preferably laterally outermost end of the front face.

The outer part section of the edge region may have a lower slope in comparison with the inner part section of the edge region.

The outer part section of the edge region can have, for example, a slope in a range of less than approximately ±5°.

The outer part section of the edge region may be of substantially bulge-free configuration at least in sections and/or the bulge does not extend as far as a laterally outer end of the valve head and/or the front face.

The bulge of the valve head can be formed, for example, at least in sections by way of a substantially spherical, parabolic or frustoconical shaped-out formation, it optionally being possible for the outer part section of the edge region to differ from the substantially spherical, parabolic or frustoconical shaped-out formation.

The bulge and/or the crest region may be arranged substantially centrally.

The outer part section of the edge region can preferably comprise the laterally outermost part of the front face, it being possible for the inner part section of the edge region to be arranged, for example, between the crest region and the outer part section of the edge region.

The inner part section of the edge region may form a lateral part of the bulge, and/or the outer part section of the edge region extends, for example, laterally next to and preferably outside the bulge.

The outer part section of the edge region and/or the at least one discontinuity can extend, for example, in a substantially annular manner, for example can extend in a substantially rotationally symmetrical manner.

In one embodiment, for example, the front face of the valve head and/or the valve head can preferably be formed in a substantially rotationally symmetrical manner.

It is to be mentioned that, within the context of the present disclosure, the front face of the valve head and therefore preferably the bulge, the crest region and/or the edge region can be shaped, for example, at least in sections in a linear and/or curved (for example, arcuate) manner.

The bulge can be shaped in a substantially spherical, parabolic or frustoconical manner.

The valve may be configured as a solid-body valve and/or vaulted valve.

The neutral axis of the valve head may extend at least in sections, expediently predominantly, on the load side, that is to say on the load side during operation, in particular on a pressure chamber side and/or combustion chamber side, of a notional or imaginary reference plane which expediently runs through the effective centre of the valve seat face of the valve head and transversely with respect to the valve stem. The effective centre of the valve seat face of the valve head is expediently defined by way of the centre of the contact area between the valve seat face of the valve head and a valve seat therefor.

The neutral axis of the valve head can extend, in particular, predominantly on the load side of the reference plane, for example by more than 50%, 60%, 70%, 80%, 90% or even by more than 95% and/or as it were completely in the valve head region laterally of the valve stem (that is to say, in particular, with blocking out of the valve stem).

In one embodiment of the present disclosure, the resulting line of action of the valve head, that is to say as it were its neutral axis, preferably extends predominantly on the load side of the resulting line of action of the valve seat face, that is to say as it were of the reference plane.

Within the context of the present disclosure, a solid-body valve preferably means solid valves, in particular valves with a solid valve stem and/or a solid valve head, that is to say, in particular, without a cavity, without a cooling cavity and/or without cooling lines.

The valve seat face of the valve head is preferably of oblique configuration.

It is possible that the expediently duct-side tulip angle of the rear face of the valve head is smaller than 20°, 15°, 12°, 10° or 8°. Here, the rear face can be shaped, for example, in a rectilinear or curved manner.

A certain reduction in the wear can also be achieved by way of the selection of a small valve seat angle of 0° in the extreme case, as a result of which, however, the flow resistance of the valve rises, with the result that the gas exchange is impeded and the fuel consumption of the internal combustion engine rises.

In accordance with one embodiment of the present disclosure, the valve seat angle of the valve seat face of the valve head is expediently greater than 25°, 30°, 35°, 40° or 45° and/or smaller than 70°, 65°, 60°, 55° or 50°, with the result that a reduction in sliding and therefore wear is made possible without flow disadvantages.

The neutral axis, that is to say, in particular, the material centre, of the valve head runs, in particular, in such a way that it is bulged towards the load side (in particular, towards the combustion chamber side and/or towards the pressure chamber side) and/or towards the outside.

The crest region of the neutral axis can preferably run eccentrically and/or coaxially relative to the valve stem, in particular in an annular manner.

The front face of the valve head may be bulged in a spherical, parabolic or frustoconical manner. Although a spherical or parabolic bulge is ideal or at least advantageous, it is complicated to manufacture. They can therefore be approximated by way of an expediently flat frustoconical bulge.

The crest region of the front face of the valve head may be oriented centrally relative to the valve stem.

The internal combustion engine may be a diesel internal combustion engine, or a gas or petrol internal combustion engine.

The rear face of the valve head may be of flatter shape than the front face of the valve head. Here, the rear face and/or the front face can be shaped, for example, in a rectilinear and/or curved manner.

As has already been mentioned above, the effective centre of the valve seat face of the valve head is defined by way of the centre of the contact area between the valve seat face of the valve head and a valve seat therefor. Within the context of the present disclosure, the effective centre of the valve seat face of the valve head can therefore be arranged, for example, actually centrally relative to the valve seat face of the valve head, or else eccentrically.

The front face of the valve head may be of substantially S-shaped configuration at least in sections in cross section, for example, preferably comprising the bulge and/or the laterally outer part section of the edge region.

The substantial S-shape can extend, for example, in an annular manner, and can preferably extend in a rotationally symmetrical manner.

The present disclosure is not restricted to a valve, but rather also comprises a valve/valve seat combination having a valve as disclosed herein and a valve seat therefor.

In addition, the present disclosure comprises a motor vehicle, preferably a commercial vehicle, in particular a lorry or an omnibus, having preferably an internal combustion engine which comprises a combustion chamber and/or pressure chamber with a valve/valve seat combination as described herein.

The above-described preferred embodiments and features of the present disclosure can be combined with one another.

BRIEF DESCRIPTION OF THE DRAWINGS

Other advantageous developments of the present disclosure are disclosed in the following description in conjunction with the appended figures, in which.

Figure 1:
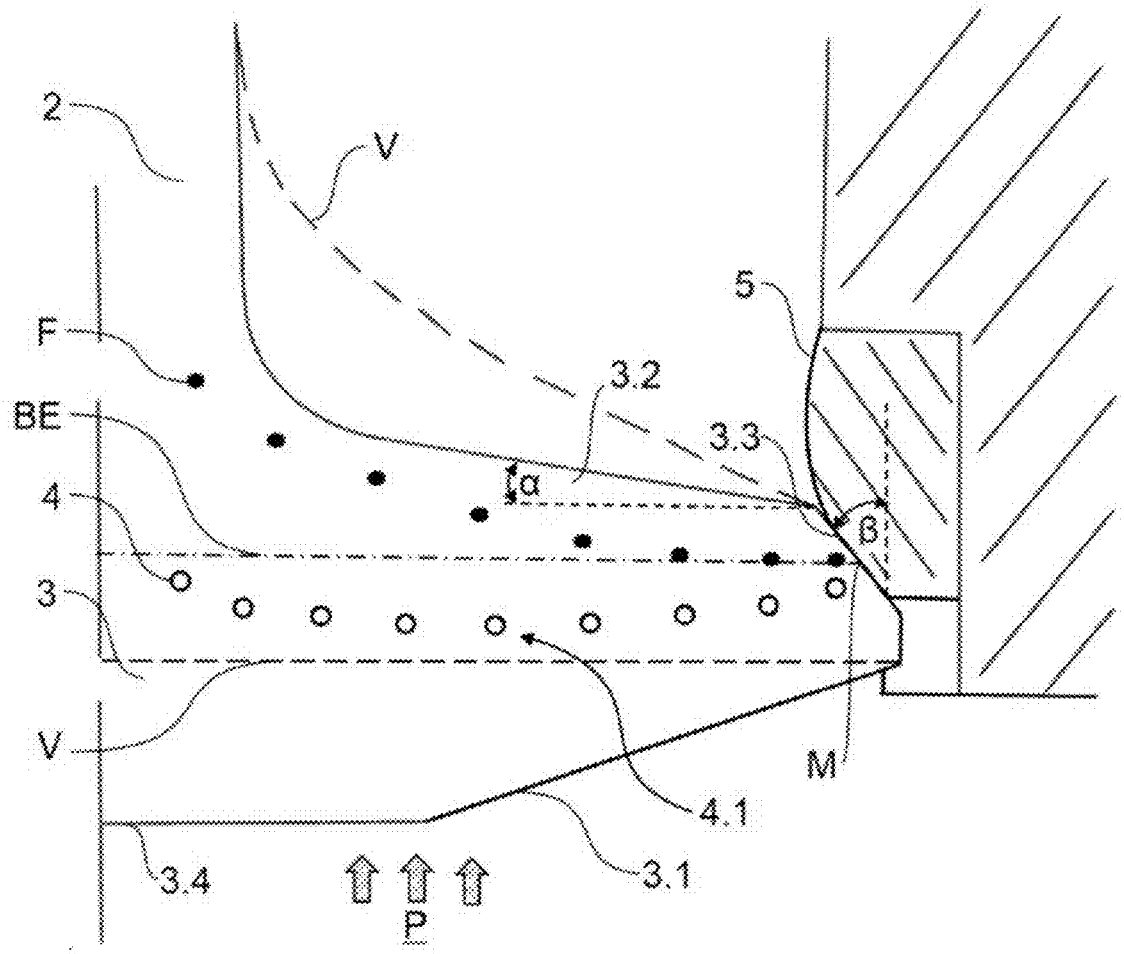
Prior Art FIG. 1
FIG. 1 shows a diagrammatic cross-sectional view of a part of two valves in accordance with the prior art.

The embodiments which are shown in the figures are partially consistent, with the result that the same reference numerals are used for similar or substantially identical parts, reference also being made to the description of the other embodiments in order to explain them, in order to avoid repetitions.

DETAILED DESCRIPTION

FIG. 1 shows a diagrammatic view of a part of a vaulted valve 1 in accordance with DE 10 2014 013 503 A1 for a petrol or gas engine or a diesel engine which meets the Euro 5 emissions standard, with the result that the valve 1 is loaded with relatively clean, low-soot exhaust gas. For comparison therewith, FIG. 1 likewise diagrammatically shows a valve V which is likewise described in DE 10 2014 013 503 A1.

In principle, the valve 100 according to the present disclosure can be substantially configured initially like the vaulted valve 1 which can be seen in FIG. 1.

The valve 1 comprises a valve stem 2 and a valve head 3. The valve head 3 comprises a front face 3.1 which faces a pressure/combustion chamber P (load side) during operation, a rear face 3.2 which faces away from the pressure/combustion chamber P during operation, and an expediently oblique valve seat face 3.3 for seating on a valve seat (seating ring) 5.

The front face 3.1 is bulged towards the outside, towards the load side P (pressure/combustion chamber) during operation, and the valve 1 is configured as a solid solid-body valve and is therefore configured without cavities, in particular without cooling lines and cooling cavities.

The neutral axis 4 and therefore the centre line of the valve head 3 is likewise bulged towards the load side P, in particular in such a way that it expediently extends at least predominantly on the load side, that is to say on the load side P during operation, of a notional or imaginary reference plane BE. The reference plane BE runs through the effective centre M of the valve seat face 3.3 of the valve head 3 and transversely with respect to the valve stem 2. The neutral axis 4 identifies as it were the resulting line of action of the valve head 3, whereas the reference plane BE identifies as it were the resulting line of action of the valve seat face 3.3.

The effective centre M of the valve seat face 3.3 of the valve head 3 is therefore defined by way of the centre of the contact area which results during operation between the valve seat face 3.3 of the valve head 3 and the valve seat 5.

The neutral axis 4 of the valve head 3 can run at least largely on the load side of the reference plane BE, in particular, by virtue of the fact that the valve 1 is configured as a solid-body valve with an outwardly bulged front face 3.1, with the result that no sliding or only very slight sliding of the valve seat face 3.3 on the valve seat 5 is produced in the case of ignition pressure loading. Since sliding is the main cause for the wear between the valve 1 and the valve seat 5, the wear is reduced or eliminated as a consequence, despite no lubricant or scarcely any lubricant in the form of relatively clean exhaust gas which supplies soot.

The crest region 3.4 of the front face 3.1 of the valve head 3 is oriented substantially centrally relative to the valve stem 2.

On account of the valve stem 2, the crest region 4.1 of the neutral axis 4 runs eccentrically relative to the valve stem 2 and in an annularly coaxial manner with respect to the valve stem 2.

The rear face 3.2 of the valve head 3 is expediently of flatter configuration than the front face 3.1 of the valve head 3. The front face 3.1 and/or the rear face 3.2 can be, for example, of rectilinear or curved configuration.

The tulip angle $\alpha$ of the rear face 3.2 of the valve head 3 is smaller than 20°, and is approximately 7° in the embodiment which is shown.

The valve seat angle $\beta$ of the valve seat face 3.3 is greater than 25°, and is approximately 40° in the embodiment which is shown.

In FIG. 1, moreover, another valve V in accordance with the prior art with a neutral axis F is indicated.

The comparison between the valve 1 and the valve V shows that the duct-side tulip angle $\alpha$ of the valve 1 is smaller (flatter) than in the case of the valve V, and in contrast the front face 3.1 is thickened and bulged, however, with the result that the neutral axis 4 is bulged towards the pressure/combustion chamber P. The shaping of the valve 1 leads to thickening of the valve 1, in particular of the valve head 3 on the side which faces the combustion/pressure chamber P, and thinning on the side which faces away from the combustion/pressure chamber P. The neutral axis F of the valve V in accordance with the prior art runs on the side which faces away from the load side P relative to the reference plane BE, that is to say above the reference plane BE in FIG. 1.

Figure 2:
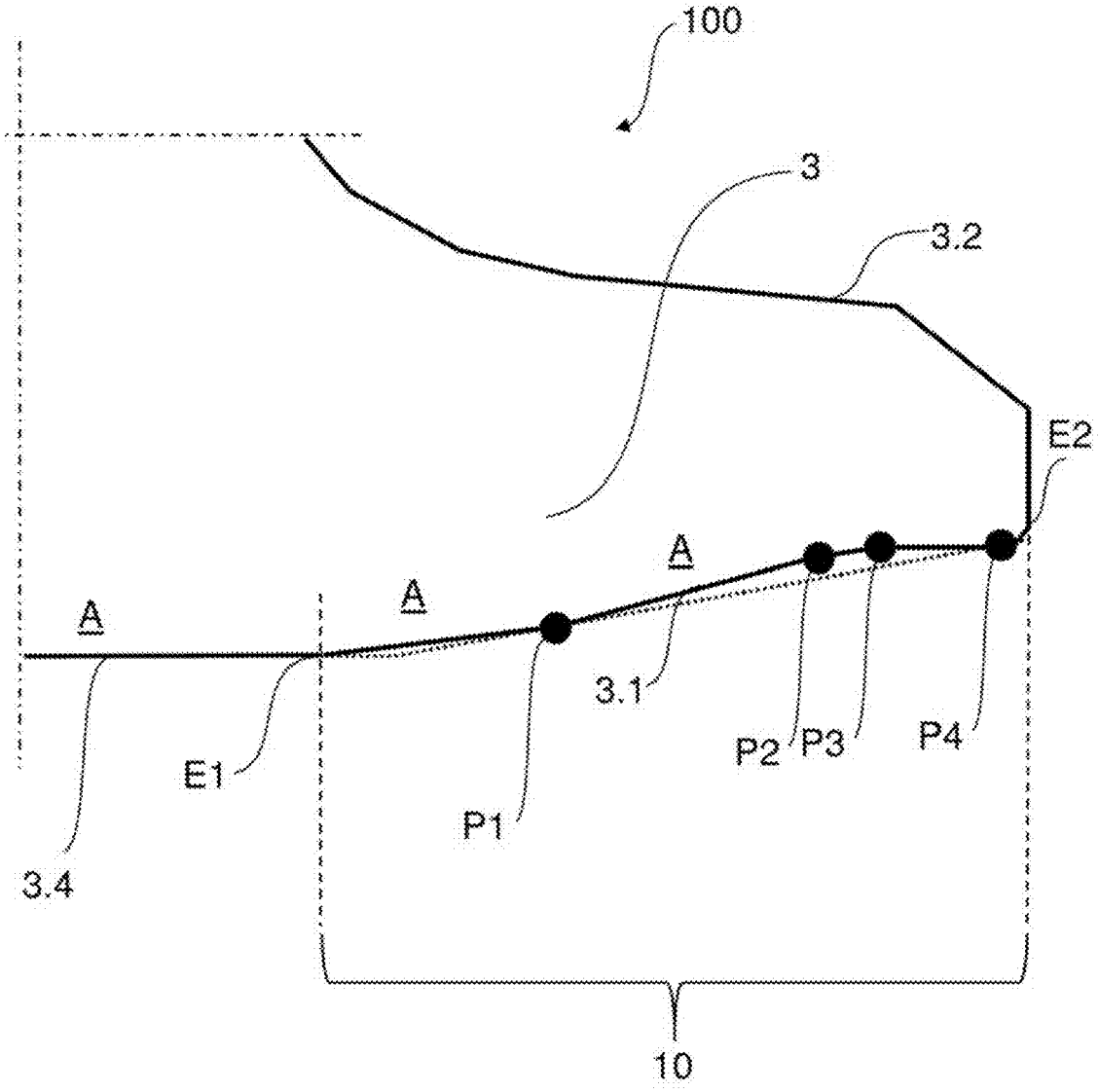
FIG. 2 shows a diagrammatic cross-sectional view of a part of a valve in accordance with one embodiment of the present disclosure.

FIG. 2 shows a diagrammatic cross-sectional view of a part of a valve 100 in accordance with one embodiment of the present disclosure using solid lines, the dotted line in principle showing the course of the edge region of the valve 1 from FIG. 1 for comparison purposes.

The valve 100 comprises a valve head 3 with a front face 3.1 and a rear face 3.2. The front face 3.1 of the valve head 3 comprises an edge region 10 and a substantially centrally arranged bulge A towards the outside, the bulge A having a crest region 3.4.

The edge region 10 is expediently delimited in cross section by way of a laterally inner end E1 and a laterally outer end E2. The inner end E1 adjoins the crest region 3.4, it being possible for the outer end E2 to be the outermost lateral end of the front face 3.1 or the valve head 3.

The edge region 10 extends in an annular manner around the bulge A of the valve head 3, and is arranged here partially laterally next to and outside the bulge A and partially on the bulge A. The bulge A itself can be of substantially spherical, parabolic or frustoconical shape at least in sections.

One feature of the valve 100 is that a laterally outer part section of the edge region 10 is of flatter configuration in comparison with a laterally inner part section of the edge region 10, and the edge region 10 comprises a plurality of discontinuities P1 to P4 in cross section, in order to reduce the mass of the bulge A, in particular the mass of the bulge base. As a result, the front face 3.1 can expediently be shaped in a substantially S-shaped manner in cross section.

In the case of the embodiment which is shown in FIG. 2, the outer part section of the edge region 10 is configured without a bulge, with the result that the outer part section has a slope of substantially 0° and, as a consequence, the outer part section of the edge region 10 has a smaller slope in comparison with the inner part section of the edge region 10. Within the context of the present disclosure, however, the outer part section can also have slopes in a range of preferably approximately ±5°.

In contrast to the vaulted valve 1, the bulge A of the valve 100 does not extend as far as the laterally outer end E2, with the result that at least the outer part section of the edge region 10 differs from the spherical, parabolic or frustoconical bulge A.

The plurality of discontinuities P1 to P4 in cross section can expediently be formed by way of at least one vertex, inflection point or reversal point, or a combination thereof.

Figure 3:
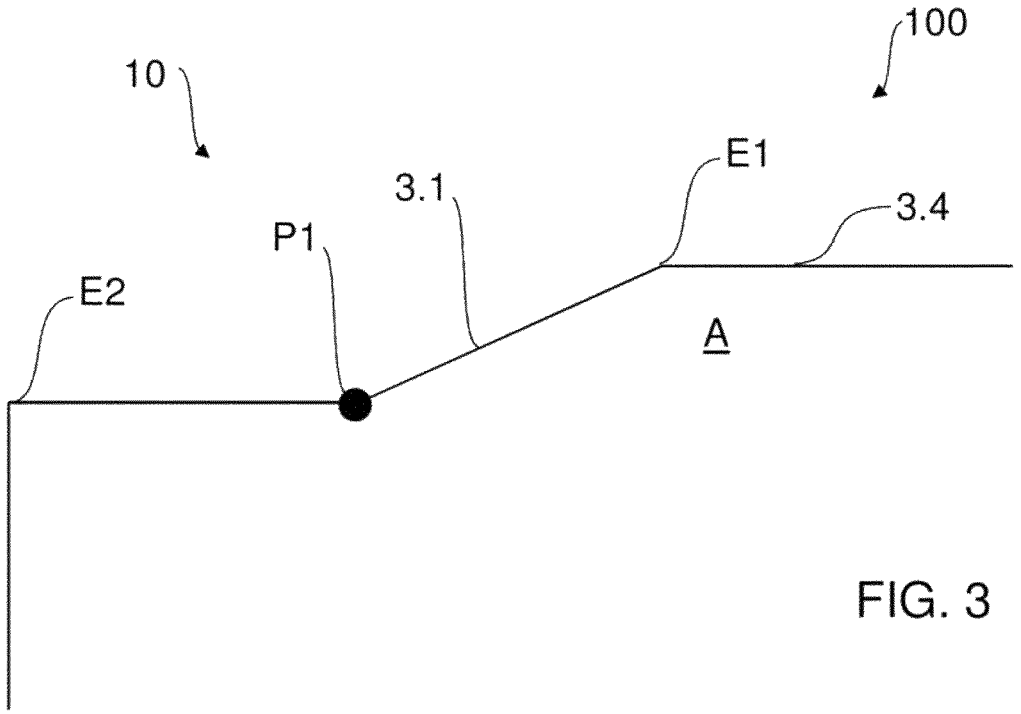
FIG. 3 shows a diagrammatic cross-sectional view of a part of a valve in accordance with another embodiment of the present disclosure.
Figure 4:
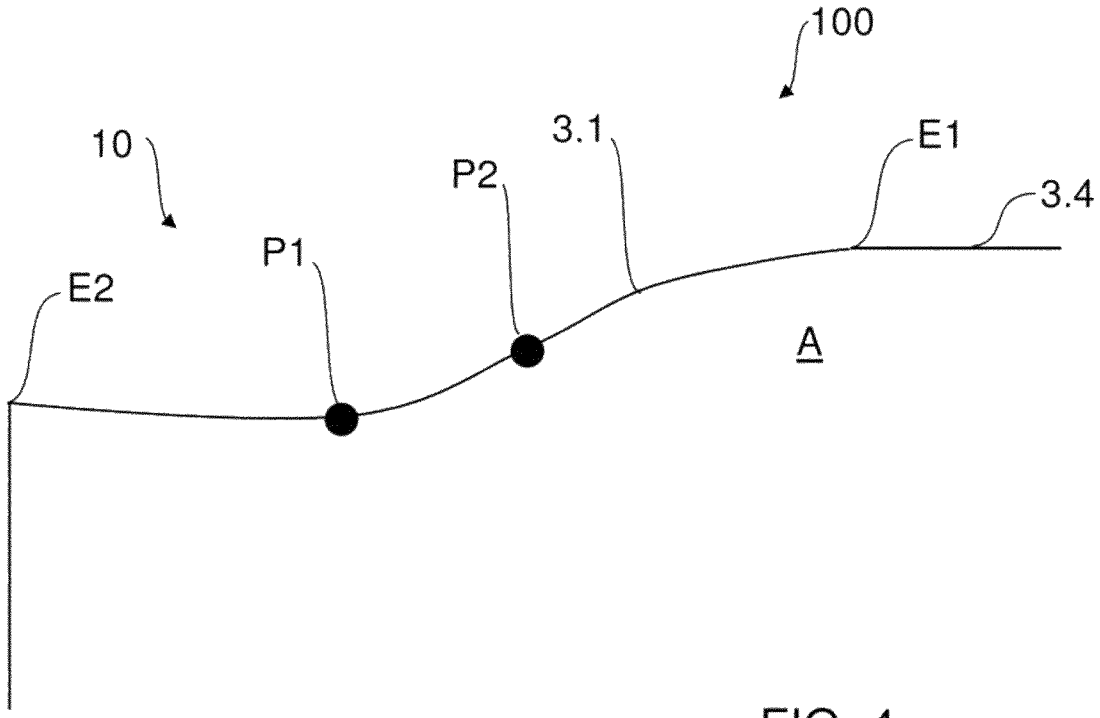
FIG. 4 shows a diagrammatic cross-sectional view of a part of a valve in accordance with yet another embodiment of the present disclosure.
Figure 5:
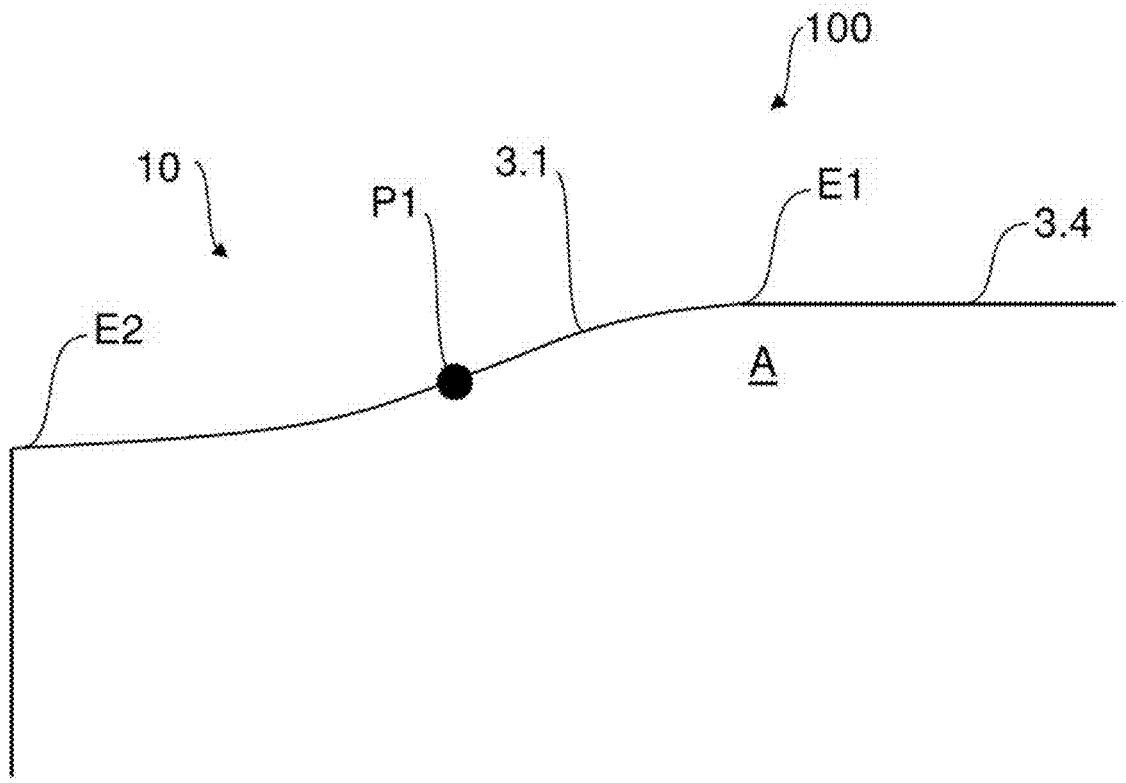
FIG. 5 shows a diagrammatic cross-sectional view of a part of a valve in accordance with yet another embodiment of the present disclosure.

FIGS. 3 to 5 show diagrammatic cross-sectional views of a part of a valve 100 in accordance with other embodiments of the present disclosure.

Here, FIG. 3 shows, in particular, an edge region 10 with part sections which run in a linear manner in cross section and one discontinuity P1.

Here, FIG. 4 shows, in particular, an edge region 10 with part sections which run in a curved manner in cross section and two discontinuities P1 and P2.

Here, FIG. 5 shows, in particular, an edge region 10 with part sections which run in a curved manner in cross section and one discontinuity P1.

Figure 6:
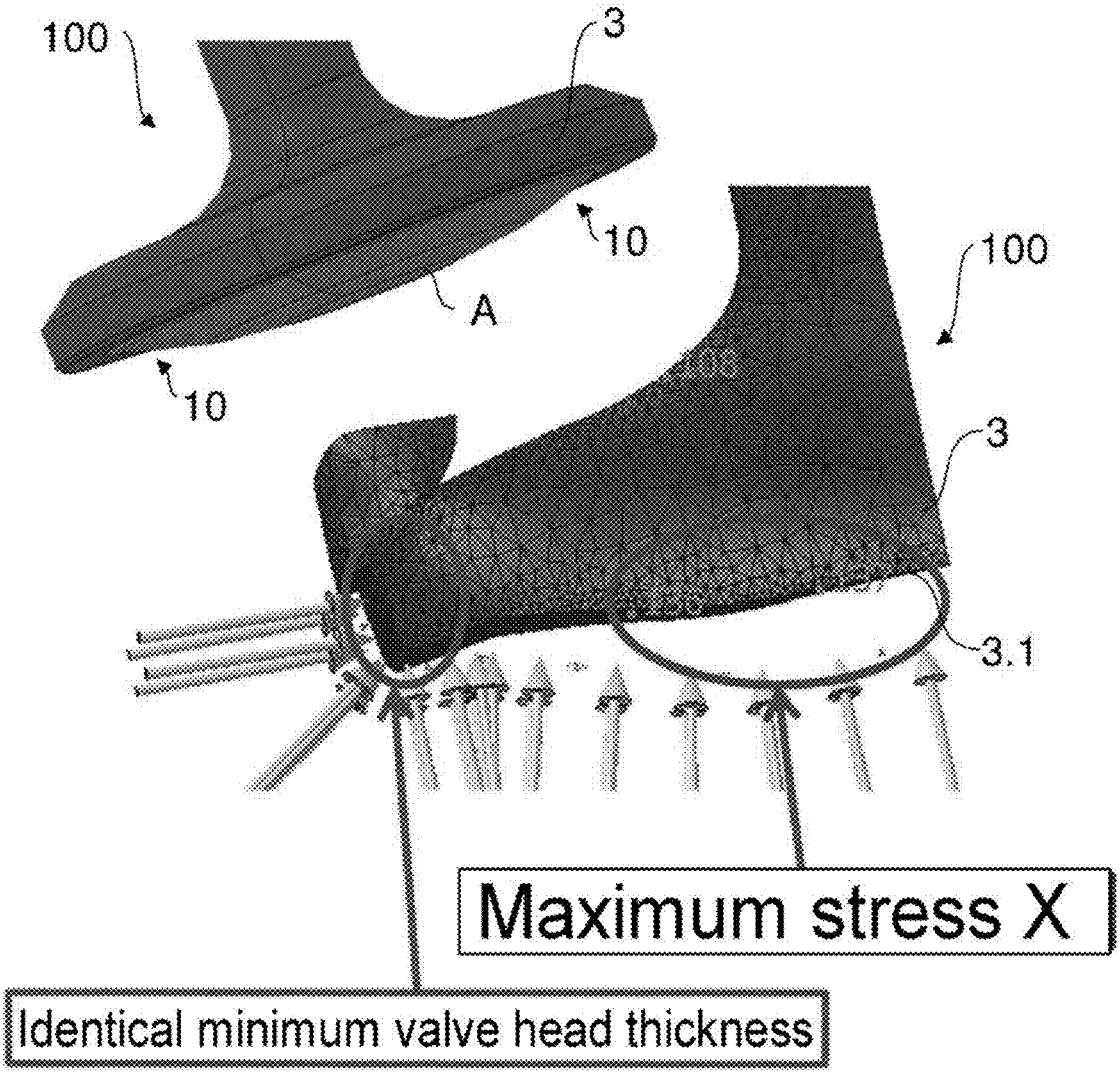
FIG. 6 shows a perspective side view of a valve in accordance with one embodiment of the present disclosure.
Figure 7:
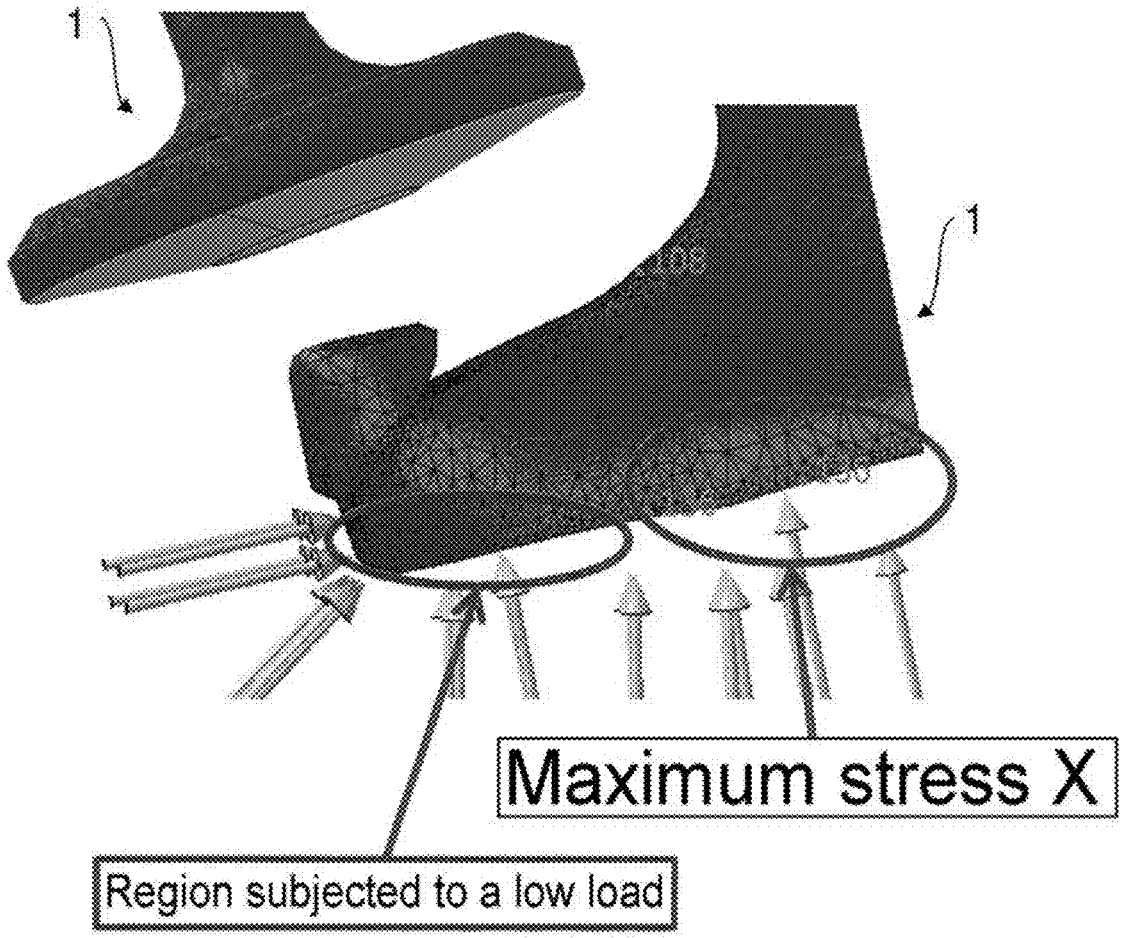
Prior Art FIG. 7
FIG. 7 shows a perspective side view of a valve in accordance with the prior art.

FIG. 6 shows a perspective side view of a valve 100 in accordance with one embodiment of the present disclosure, FIG. 7 showing a perspective side view of the vaulted valve 1.

In the case of the vaulted valve 1 which can be seen in FIG. 7 and can be configured in accordance with DE 10 2014 013 503 A1 as has already been mentioned above, it is possible that the edge region of the valve head 3, in particular the bulge base, is not loaded or is at least not loaded substantially during operation, for example by way of a compression spring force and/or valve spring force.

In the case of the valve 100 which can be seen in FIG. 6, the outer part section of the edge region 10 is therefore of flatter configuration in comparison with the inner part section of the edge region 10, in order to reduce the mass of the bulge A of the valve head 3, the edge region 10 comprising at least one discontinuity P1 to P4 in cross section, in order, as a result, to remove the mass which is not loaded or is loaded only insubstantially during operation.

Despite an identical minimum wall thickness of the valve head in comparison with the vaulted valve 1, this can make it possible that the maximum stress of the valve head 3 of the valve 100 and the maximum stress of the valve head 3 of the vaulted valve 1 remain substantially identical, for example with a maximum stress X of, for example, approximately from 136 to 137 Mpa.

The present disclosure is not restricted to the above-described preferred embodiments. Rather, a multiplicity of variants and modifications are possible which likewise utilize the concept of the present disclosure and therefore fall within the scope of protection.

LIST OF REFERENCE SIGNS

1 Valve in accordance with the prior art
2 Valve stem
3 Valve head
3.1 Front face of the valve head
3.2 Rear face of the valve head
3.3 Valve seat face
3.4 Crest region of the front face of the valve head
4 Neutral axis
4.1 Crest region of the neutral axis
5 Valve seat
α Tulip angle of the rear face of the valve head
β Valve seat angle of the valve seat face of the valve head
P Load side, in particular combustion chamber side and/or pressure chamber side
BE Reference plane
M Effective centre of the valve seat face
V Valve in accordance with the prior art
F Neutral axis of the valve head of the valve V
100 Valve
10 Edge region
P1 Discontinuity
P2 Discontinuity
P3 Discontinuity
P4 Discontinuity
A Bulge
E1 Laterally inner end
E2 Laterally outer end

I claim:

1. A valve comprising:

a valve head which has a front face and a rear face, the front face of the valve head including an edge region and a bulge which has a crest region, wherein in order to reduce the mass of the bulge of the valve head, a laterally outer part section of the edge region is of flatter configuration in comparison with a laterally inner part section of the edge region, or the edge region includes at least one discontinuity in cross section, wherein the valve is configured as a solid-body valve and wherein a neutral axis of the valve head extends in sections on a load side of an imaginary reference plane, the reference plane running through an effective centre of a valve seat face of the valve head and transversely with respect to a valve stem of the valve.

2. The valve according to claim 1, wherein the valve is an exhaust gas or gas exchange valve.

3. The valve according to claim 1, wherein in order to reduce the mass of the bulge of the valve head, the edge region includes at least one discontinuity in cross section, wherein the at least one discontinuity includes at least one vertex, inflection point or reversal point.

4. The valve according to claim 1, wherein in order to reduce the mass of the bulge of the valve head, the edge region includes at least one discontinuity in cross section, wherein, in cross section, the at least one discontinuity is arranged on the outside relative to a laterally inner end of the edge region or is arranged on the inside relative to a laterally outer end of the edge region.

5. The valve according to claim 4, wherein the inner lateral end adjoins the crest region or the outer lateral end is the outermost lateral end of the front face.

6. The valve according to claim 1, wherein the outer part section of the edge region has a lower slope in comparison with the inner part section of the edge region, or the outer part section of the edge region has a slope in a range of less than ±5°.

7. The valve according to claim 1, wherein the outer part section of the edge region is of substantially bulge-free configuration at least in sections or the bulge does not extend as far as a laterally outer end of the valve head.

8. The valve according to claim 1, wherein the bulge of the valve head is formed by way of a spherical, parabolic or frustoconical shaped-out formation, wherein the outer part section of the edge region differs from the spherical, parabolic or frustoconical shaped-out formation.

9. The valve according to claim 1, wherein the bulge of the valve head is arranged centrally and the outer part section of the edge region includes the laterally outermost part of the front face.

10. The valve according to claim 1, wherein the inner part section of the edge region forms a lateral part of the bulge, or the outer part section of the edge region extends laterally next to and outside the bulge.

11. The valve according to claim 1, wherein the outer part section of the edge region or the at least one discontinuity extends annularly in a rotationally symmetrical manner.

12. The valve according to claim 1, wherein the neutral axis of the valve head is bulged towards the load side.

13. The valve according to claim 1, wherein the crest region of the neutral axis runs eccentrically relative to the valve stem.

14. The valve according to claim 1, wherein the neutral axis of the valve head extends predominantly on the load side of the reference plane.

15. The valve according to claim 1, wherein the effective centre of the valve seat face of the valve head is defined by way of the centre of the contact area between the valve seat face of the valve head and a valve seat.

16. The valve according to claim 1, wherein the front face of the valve head is of S-shaped configuration at least in sections in cross section.

17. A valve/valve seat combination comprising:

a valve including a valve head which has a front face and a rear face, the front face of the valve head including an edge region and a bulge which has a crest region, wherein in order to reduce the mass of the bulge of the valve head, a laterally outer part section of the edge region is of flatter configuration in comparison with a laterally inner part section of the edge region, or the edge region includes at least one discontinuity in cross section, wherein the valve is configured as a solid-body valve and wherein a neutral axis of the valve head extends in sections on a load side of an imaginary reference plane, the reference plane running through an effective centre of a valve seat face of the valve head and transversely with respect to a valve stem of the valve; and a valve seat for the valve.

18. A motor vehicle, comprising:

a valve/valve seat combination, the combination further comprising, a valve including a valve head which has a front face and a rear face, the front face of the valve head including an edge region and a bulge which has a crest region, wherein in order to reduce the mass of the bulge of the valve head, a laterally outer part section of the edge region is of flatter configuration in comparison with a laterally inner part section of the edge region, or the edge region includes at least one discontinuity in cross section, wherein the valve is configured as a solid-body valve and wherein a neutral axis of the valve head extends in sections on a load side of an imaginary reference plane, the reference plane running through an effective centre of a valve seat face of the valve head and transversely with respect to a valve stem of the valve; and a valve seat for the valve.

19. The motor vehicle of claim 18, wherein the motor vehicle is a commercial vehicle.

* * * * *